US007427079B2

(12) United States Patent
Piva

(10) Patent No.: US 7,427,079 B2
(45) Date of Patent: Sep. 23, 2008

(54) SNOWBOARD BINDING

(75) Inventor: Gianni Piva, Cornuda (IT)

(73) Assignee: Piva S.R.L., Onigo di Pederobba (Treviso) (IT)

( * ) Notice: Subject to any disclaimer, the term of this patent is extended or adjusted under 35 U.S.C. 154(b) by 398 days.

(21) Appl. No.: 11/039,465

(22) Filed: Jan. 20, 2005

(65) Prior Publication Data

US 2005/0161911 A1 Jul. 28, 2005

(30) Foreign Application Priority Data

Jan. 23, 2004 (IT) ..... VI2004A0012

(51) Int. Cl.
*A63C 9/00* (2006.01)
*A63C 9/20* (2006.01)

(52) U.S. Cl. ..... 280/623; 280/14.24

(58) Field of Classification Search ..... 280/14.2, 280/613, 618, 625, 626, 631, 14.22, 627, 280/633, 634
See application file for complete search history.

(56) References Cited

U.S. PATENT DOCUMENTS 4,058,326 A * 11/1977 Faulin ..... 280/617
5,556,123 A * 9/1996 Fournier ..... 280/607
5,692,765 A * 12/1997 Laughlin ..... 280/619
5,857,700 A * 1/1999 Ross ..... 280/623
5,997,027 A * 12/1999 Jungkind ..... 280/617
6,003,893 A * 12/1999 Hansen ..... 280/624
6,007,077 A * 12/1999 Moe ..... 280/14.22
6,065,770 A * 5/2000 Hansen et al. ..... 280/617
6,116,634 A * 9/2000 Mometti ..... 280/613
6,293,577 B1 * 9/2001 Shields ..... 280/617
6,938,913 B2 * 9/2005 Elkington ..... 280/607
6,945,543 B2 * 9/2005 De Bortoli et al. ..... 280/14.21
2001/0009320 A1 * 7/2001 Couderc et al. ..... 280/14.24

* cited by examiner

*Primary Examiner*—Christopher P. Ellis
*Assistant Examiner*—Bridget Avery
(74) *Attorney, Agent, or Firm*—Bucknam and Archer

(57) ABSTRACT

There is disclosed a snowboard binding which is equipped with a single strap which acts as a collar for the boot and which is hinged at one side on the base of the binding and at the opposite side it is fastened to a triangularly-shaped fastening system which, in turn, is secured to the base of the binding.

3 Claims, 7 Drawing Sheets

SNOWBOARD BINDING

BACKGROUND OF THE INVENTION

The present invention relates to snowboard bindings.

In snowboard bindings currently being produced, the anchoring between the binding, which is attached to the board, and the boot is normally carried out through the use of two straps that, when the aforementioned piece of apparatus, i.e. the boot, is slotted in, are respectively positioned one at the heel area and the other at the toe area of the boot. Normally, each of the two straps is fixed to the base of the binding, respectively, on one side through a screw or other connection element and that is adjusted just once, when it is first slotted on and, on the other side, through a quick fastener, equipped with a continuous length adjustment system, substantially consisting of a toothed element that engages with a micro metric actuation mechanism in the form of a ratchet, defined by the term "pumping element."

First, through the fastening action of the two straps, independent from each other, and then with the ratchet-like closing action of the pumping element, the user, when he slots the boot onto the binding, adjusts the traction force between the two elements that make up the strap itself, or rather "sets" the value of the clamping force of the binding. Such a method of operation, as enthusiasts of this sport know very well, has the drawback of requiring the user to carry out a double adjustment that must be carried out after each run.

In the current state of the art, snowboard bindings have been made that foresee just one fastening point of the two straps, so as to reduce the operations to be carried out to slot into the apparatus. However, such a constructive solution, although it reduces the fastening points, has the drawback of discharging the manoeuvring force imparted by the user's foot during use of the apparatus on a single point of the base of said apparatus. Such concentration of a substantial force at a single point causes a deformation of the base of the binding, which can reach high values, with a consequent loss of precision and stability in movement, up to the point of possibly breaking the base itself resulting in injury to the user of the apparatus.

SUMMARY OF THE INVENTION

The object of the present invention is to provide a snowboard binding that does not have the drawbacks suffered by similar known products.

This object is accomplished by providing a snowboard binding wherein a single strap acts as a collar for the boot and wherein said strap is hinged, respectively on one side on the base of the apparatus and on the opposite side it is clipped to an articulated fastener that substantially resembles a frame with at least three sides, applied to the base itself. Specifically, the strap clips to the binding on the upper vertex of its substantially triangular configuration whereas the base of the triangle is stably anchored onto the base of the apparatus.

Moreover, the substantially triangular profile of the fastener can take a variable angular opening so as to allow the strap to clip to it, with whatever shape that the aforementioned strap must adopt in order to be able to adapt to the different sizes and configurations of the various boots.

BRIEF DESCRIPTION OF THE DRAWINGS

The present invention will be better understood through the description of some possible embodiments thereof, given as non-limiting examples, with the help of the attached drawings, wherein:

FIG. 1 is a side elevational view of the binding according to the present invention which is arranged towards the outside when the apparatus is slotted on;

DETAILED DESCRIPTION OF THE INVENTION

Figure 1:
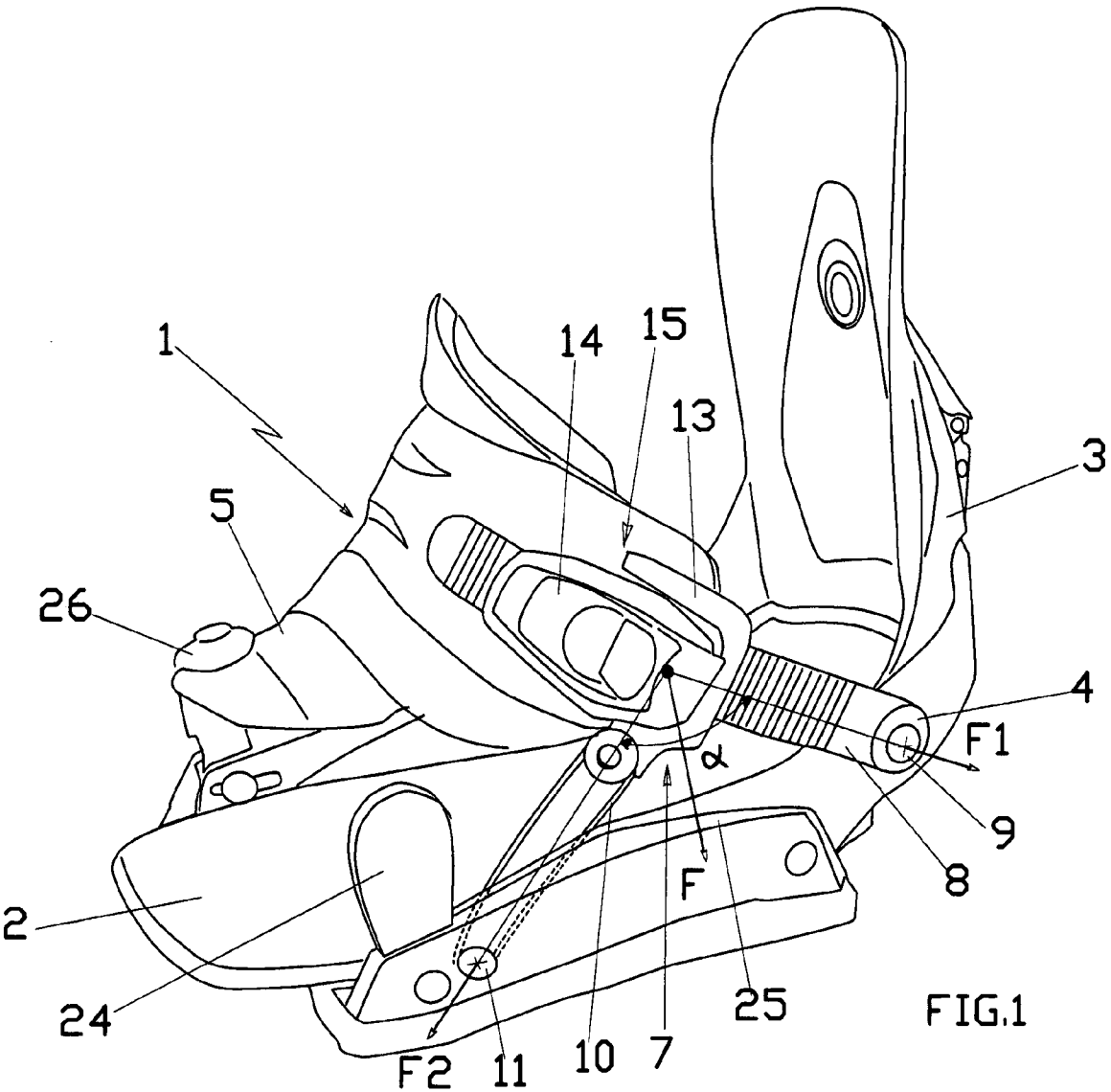
Figure 2:
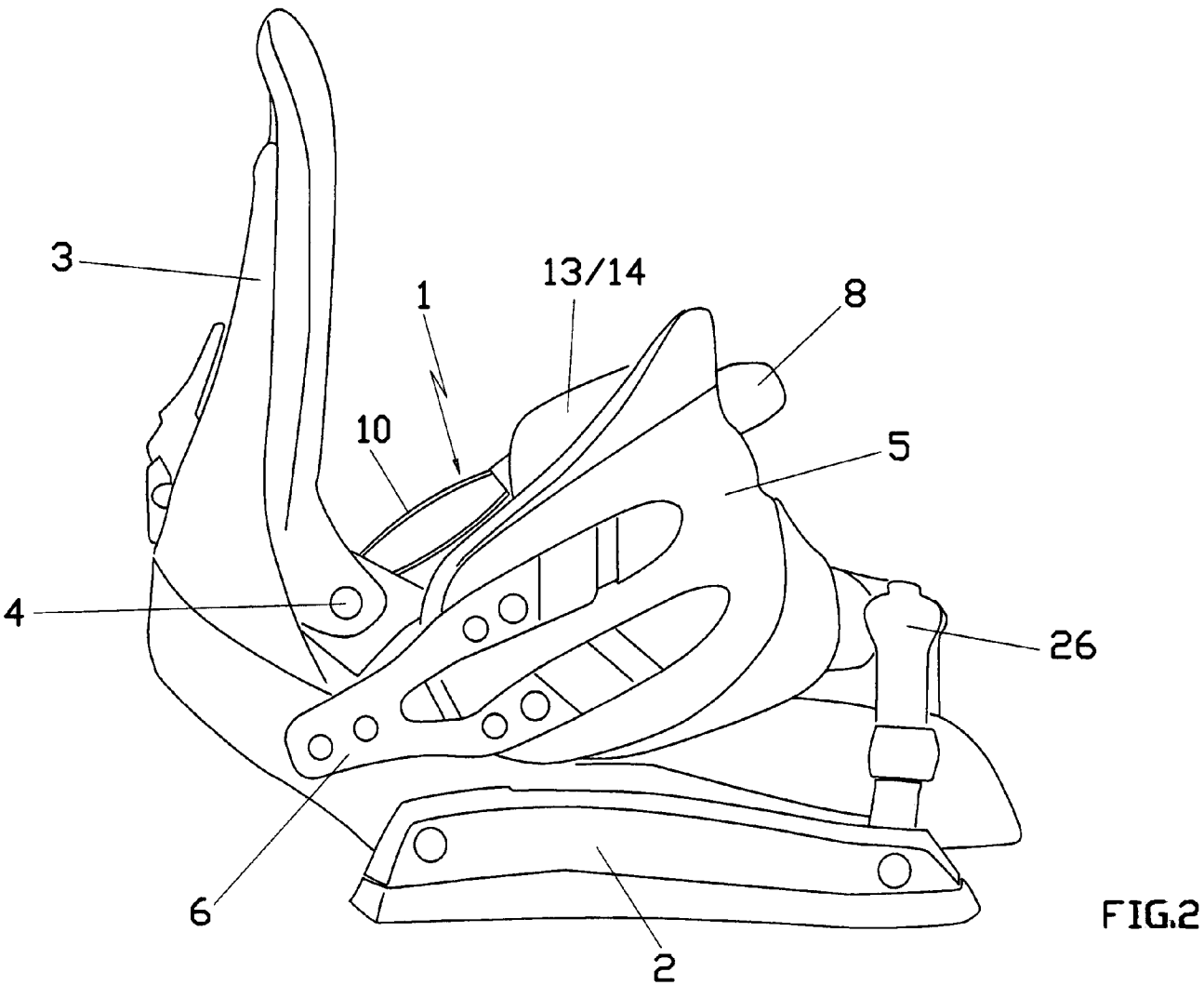
FIG. 2 is a side elevational view of the binding, opposite to the side view shown in FIG. 1.
Figure 4:
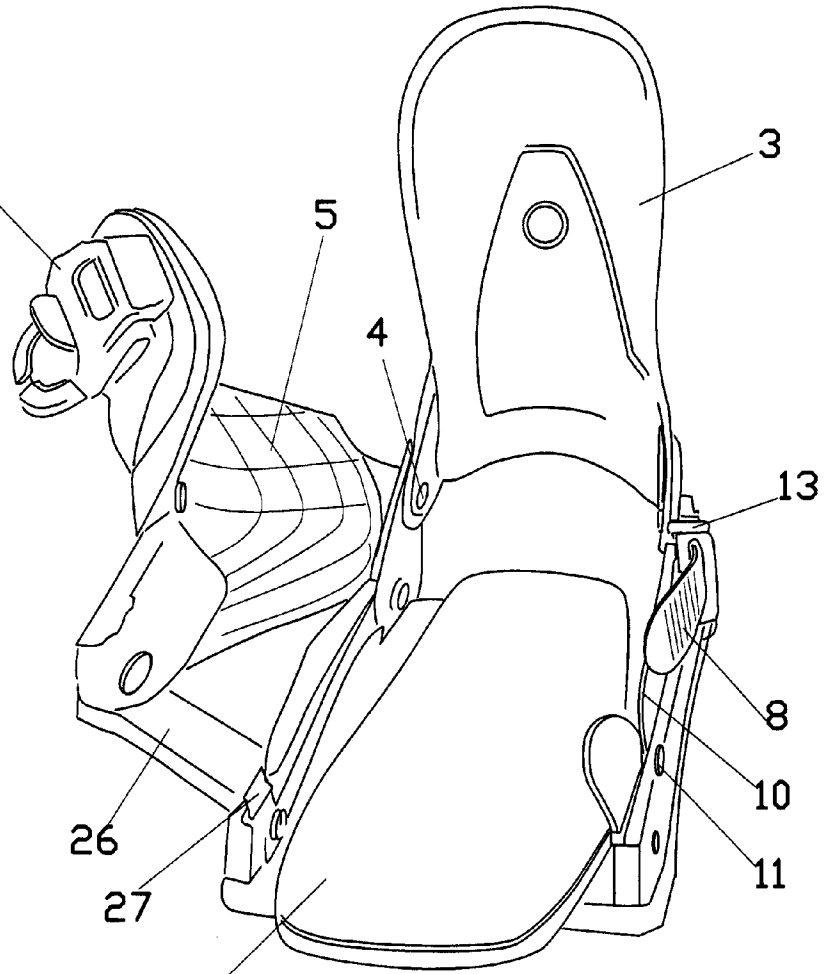
FIG. 4 is a front view of the binding according to FIG. 1 in the open position.
Figure 3:
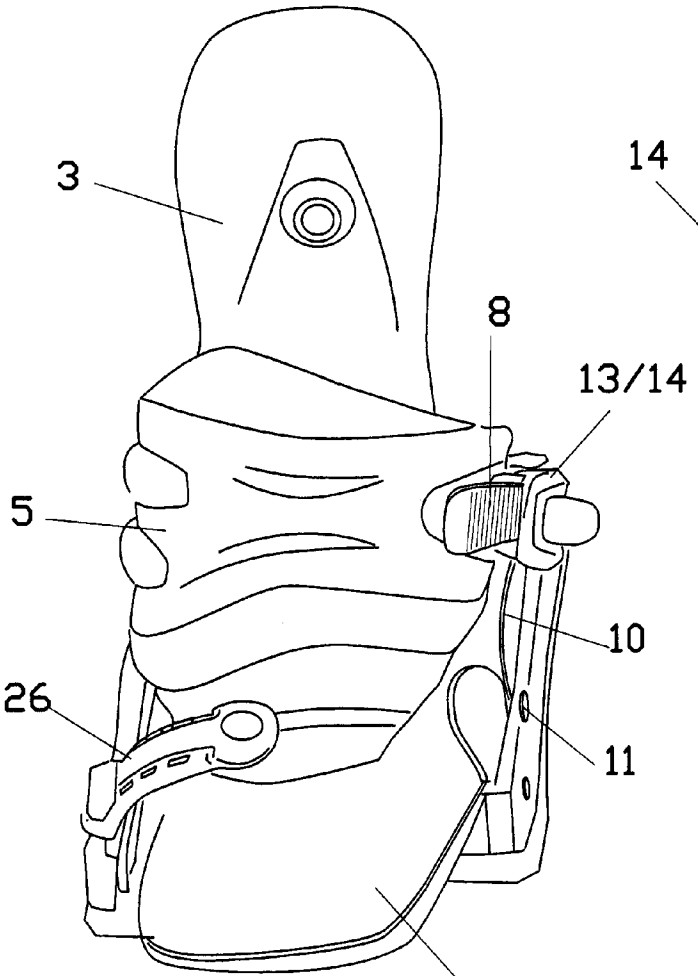
FIG. 3 is a front view of the binding according to FIG. 1 in the closed position.

As can be seen from the drawings, the snowboard binding according to the invention, generally indicated with reference numeral 1, is of the type comprising a horizontal base 2 and a vertical wall 3, for containing and supporting the boot, said two elements being fixed together in the side binding points 4.

The boot, when it is put on or mounted, is held on the apparatus through a single strap 5, arranged transversally and that is positioned substantially at the instep of the boot or foot.

Such a single strap 5 is connected to the base 2, on one side, through the adjustment tang 6, of the per se known type used in standard straps, which allows the aforementioned single strap to be centred at the middle of the boot, an operation that is carried out just once when the equipment is first used.

On the opposite side, the side facing outwardly, when the apparatus is slotted in, the single strap 5 is connected to the base 2 through a fastening system, generally indicated by the reference numeral 7. Fastening system 7 is substantially in the form of an articulated frame that has a configuration comparable, from the kinematic point of view, to a "triangle of forces," in which the sides of the configuration practically consist of a toothed strap 8, hingedly connected to a pin 9, arranged close to the heel area and which can correspond with the aforementioned binding point 4 and a connecting rod-tie rod 10, hingedly connected to the pin 11 on the base 2, the base constituting the third side of the frame.

The toothed strap 8 and the connecting rod-tie rod 10 are connected together through a block 13, able to slide or lock, as better described hereafter, on the toothed strap 8.

The single strap 5 connects to the fastening system 7 through the action of the pumping or ratcheting element 14, which, engaging on the teeth of the toothed strap 8, slides on the latter until the regular fastening of the single strap 5 itself is achieved.

As can be seen in FIG. 1, in a first embodiment, the single strap 5 connects to the fastening system 7 through a so-called "quick fastener," generally indicated with reference numeral 15, made between the sliding block 13 and the pumping element 14.

Figure 5:
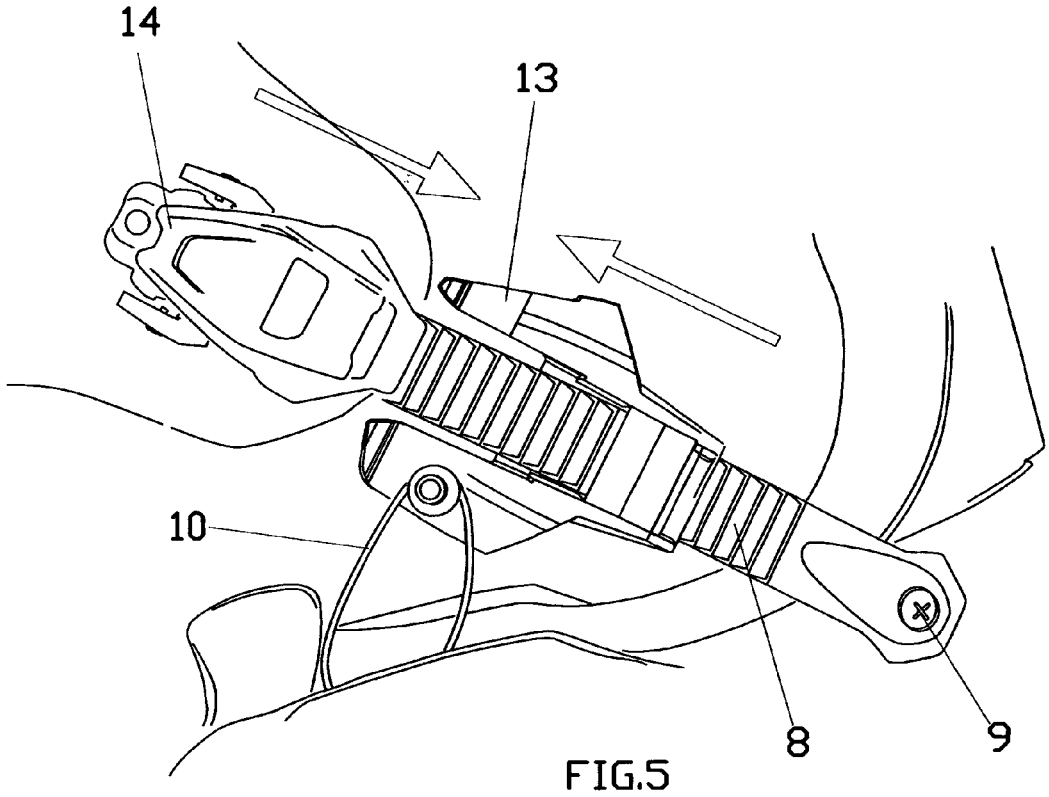
FIG. 5 is a detailed view of the fastening area in the open position according to a first embodiment of the present invention.
Figure 6:
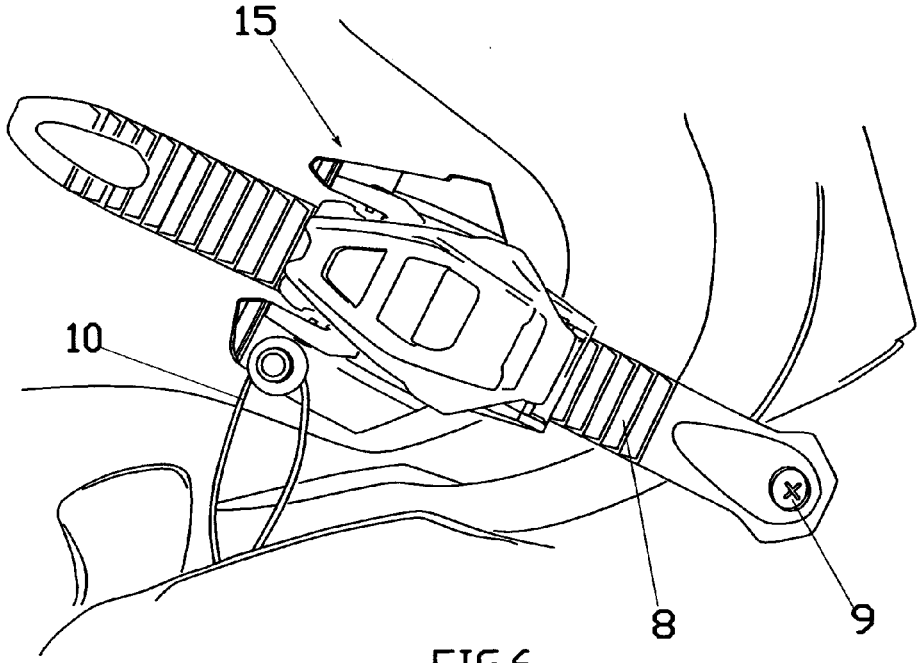
FIG. 6 is a detailed view of the fastening area in the closed position according to the first embodiment of the present invention.

In operation, as can be seen in particular in FIGS. 5 and 6, from the open position shown in FIG. 5 where both the block 13 and the pumping element 14 are spaced apart from each other and free to slide on the strap 8, one passes to the mutual fastening position shown in FIG. 6 for which reason the user, acting on the pumping element 14, takes care of making the entire fastener 15 slide on the aforementioned strap so as to perfectly "set" the fastening force of the single strap 5 on the boot, in such a way making a "self-adjusting fastener."

As can easily be seen from FIG. 1, the snowboard binding according to the invention has kinematic operation through which, thanks to the creation of a "triangle of forces," made up of the toothed strap 8, the connecting rod-tie rod 10, the base 2 and possibly other reinforcement elements, which however do not alter the aforementioned triangular configuration, allows the traction force that occurs through the force "F" and that acts on the fastener 15 of the single strap 5 to be divided into two component forces. The component forces of force "F" are a force "F1" that discharges near to the heel area, at the pin 9 of the toothed strap 8 and a force "F2" that discharges through the fastening point 11 of the connecting rod 10, in the front portion of the base 2.

In this manner, the two component forces F1 and F2 are of low intensity with respect to the main force F, for which reason they discharge on the base 2 tensions that do not deform the base itself.

Again, as seen in FIG. 1, thanks to the combined action of the hinging of the connecting rod-tie rod 10 on the pin 11, the hinging of the strap 8 on the pin 9 and the sliding of the fastener 15 on the toothed strap 8, an articulated "triangle of forces" is made, which allows the angle "$\alpha$" to be varied, so that the single strap 5 can adapt to any shape of the shell of the boot.

Figure 7:
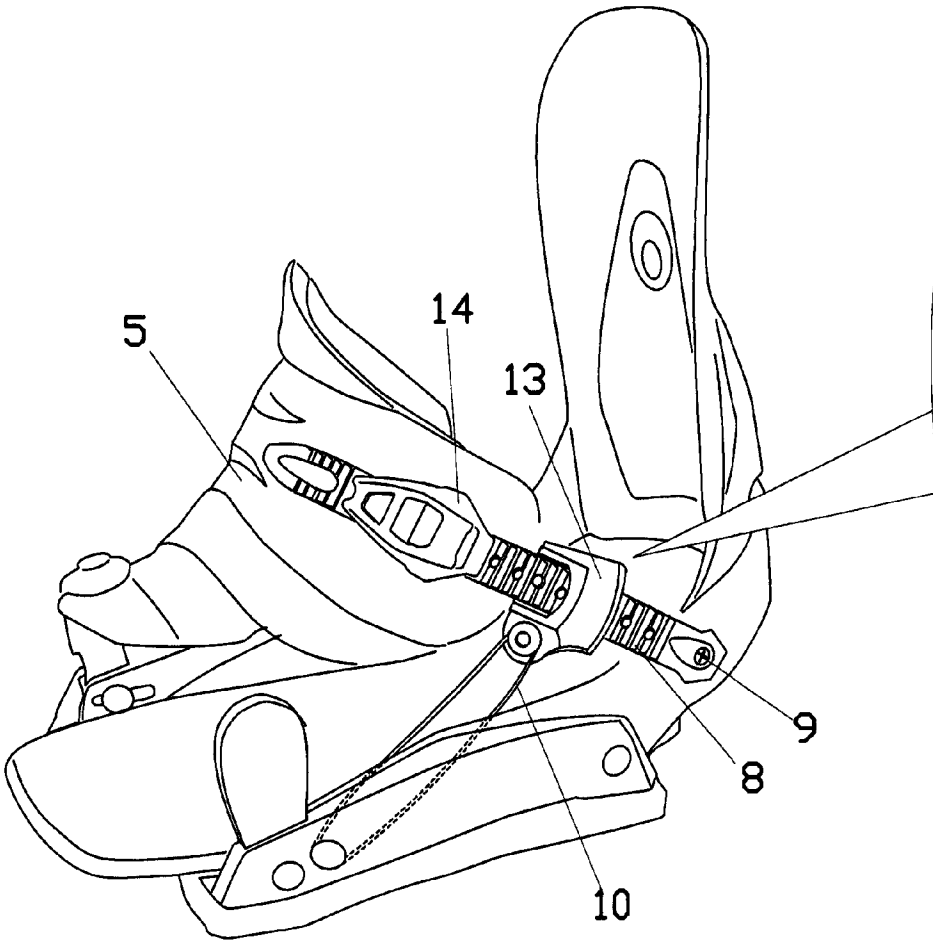
FIG. 7 is a side elevational view of the fastening area of the binding according to a second embodiment of the present invention.

As clearly seen in FIG. 7, in a second embodiment of the binding according to the invention, block 13 is integral with the toothed strap 8, whereas the "setting" of the single strap 5 is carried out through the fastening and sliding of the pumping element 14 on the aforementioned straps, in such a way to result in a "fixed position adjustable fastener."

The positioning and locking of the block 13 on the strap 8, which is carried out one time, when the apparatus is first slotted on, is obtained through fixed or elastic interlocking systems, which uses screws, rivets or other rigid or flexible elements.

Figure 8:
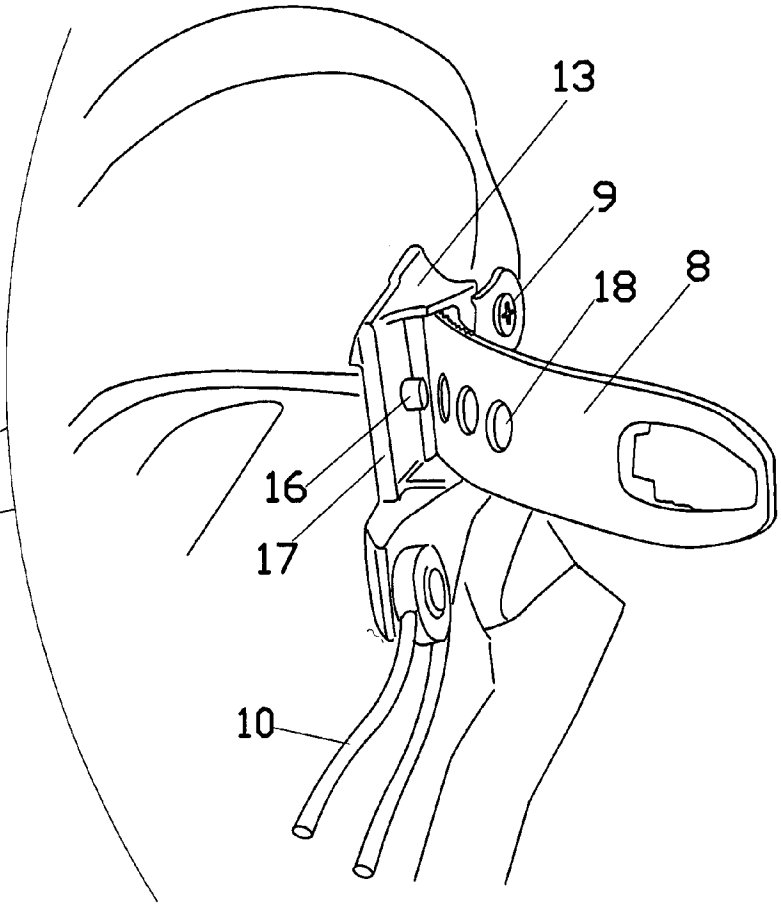
FIG. 8 is a detailed view of the fastening area of the binding according to the second embodiment of the present invention.

As can be seen in FIG. 8, a preferential embodiment of the connection of the block 13 with the strap 8 of the fixed interlocking type, is made through a ratchet or pin 16, projecting from the base 17 of the block itself and which slots onto one of a series of holes 18 formed on the aforementioned strap.

Figure 9:
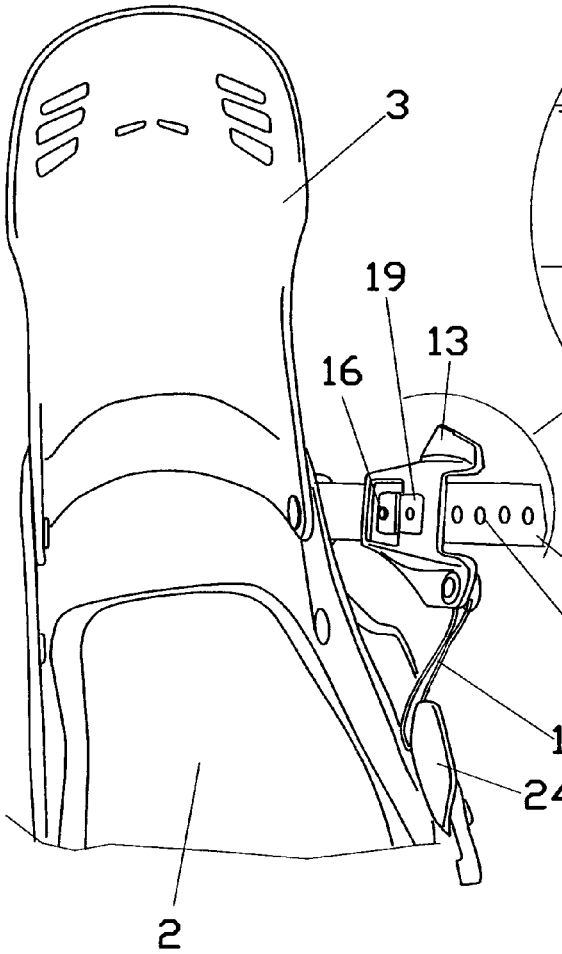
FIG. 9 is an overall view of the block of the binding according to a third embodiment of the invention.
Figure 10:
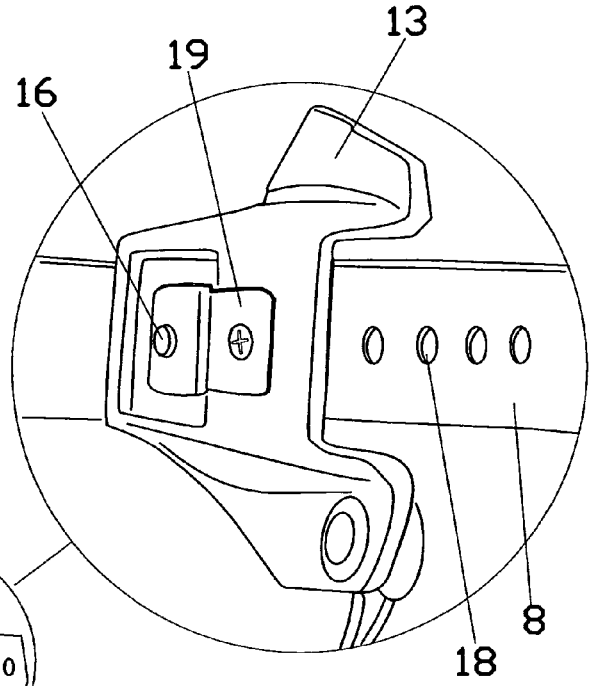
FIG. 10 is a detailed view of the block of the binding according to a third embodiment of the invention.
Figure 11:
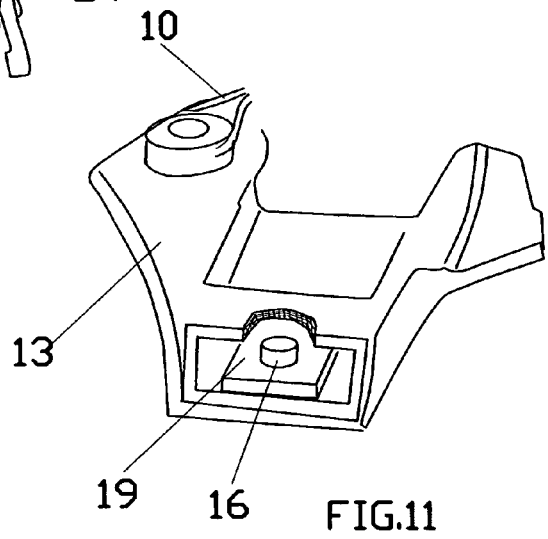
FIG. 11 is a perspective view of the block of the binding according to a third embodiment of the invention.

On the other hand, as can be seen in FIGS. 9 to 11, a preferential embodiment of the connection of the block 13 with the strap 8 of the elastic interlocking type, which eases the aforementioned fastening/unfastening operation, is made by applying the ratchet 16 on an elastic foil 19 applied cantilevered below the base 17 of the block 13, so that the aforementioned ratchet is flexible.

Figure 12:
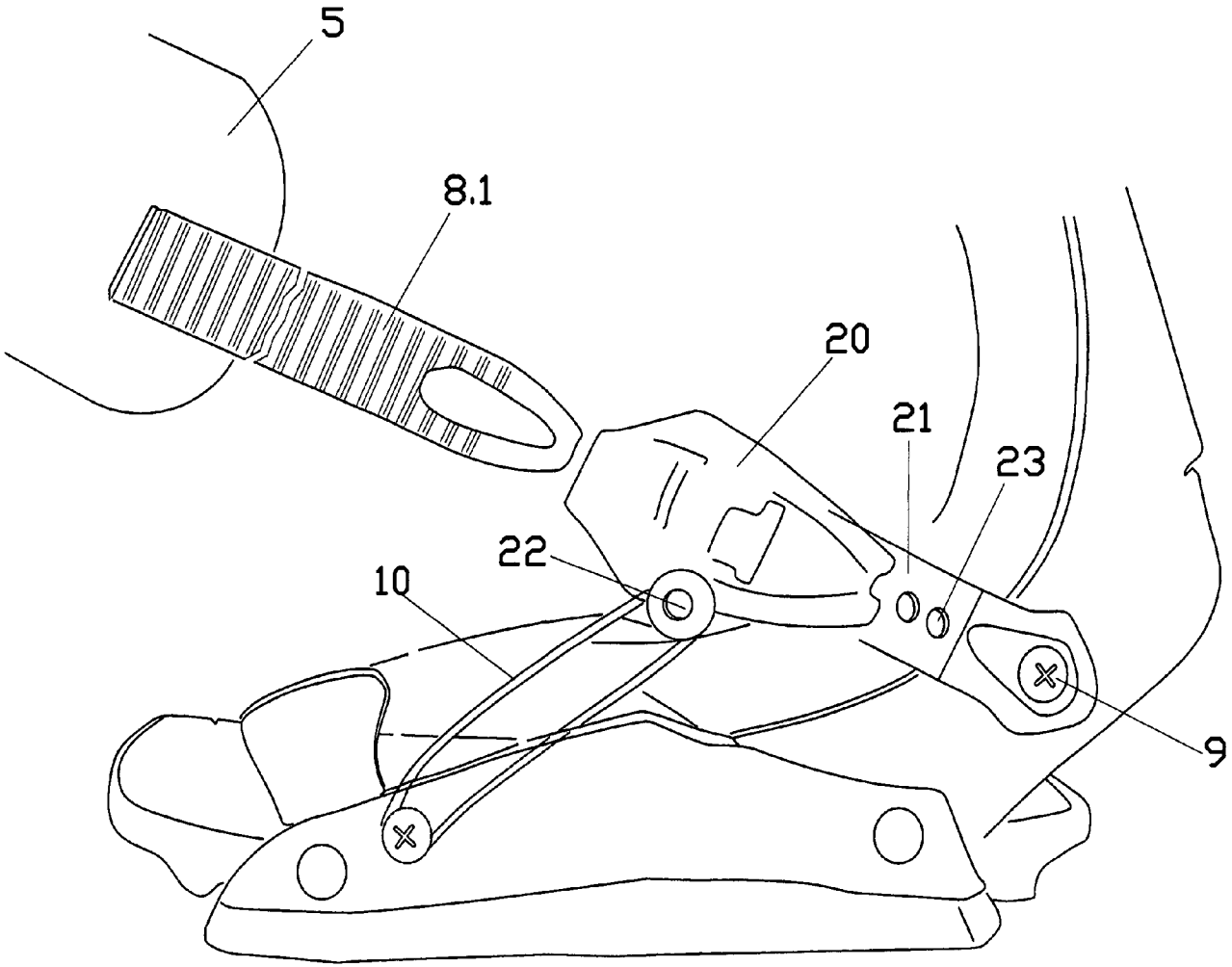
FIG. 12 is a side elevational view of the fastening area of the binding according to a fourth embodiment of the invention.

As clearly seen in FIG. 12, in a fourth embodiment of the binding according to the invention, which is much simplified with respect to the previous ones, since the use of the block 13 is eliminated, the toothed strap 8.1 is connected to the single strap 5 and where the kinematic scheme of the "triangle of forces" is obtained wherein the pumping element 20 is applied onto the strap 21, in turn hinged to the pin 9, so as to form a side of the triangle and wherein, again on the pumping element 20, the connecting rod 10, which constitutes the other side of the configuration, is connected through the pin 22 to the binding base.

This fourth constructive solution also forms a "fixed position adjustable fastener," where the positioning and locking of the pumping element 20 on the strap 21, is carried out one time, when the apparatus is first slotted on, and takes place through fixed or removable interlocking systems, which use screws, rivets or other rigid or flexible elements that engage on one of the holes 23.

For safe use of the binding of the present invention, a flap 24 projects from the base 2, in a frontal position, so as to prevent the boot from riding over the side edge 25 of the binding, in the case in which an accentuated rotation of the foot causes it to lift up.

Moreover, in order to allow greater adaptation of the single strap 5, it can be fixed to the base 2, in its front part, through a tang 26, of adjustable length, so as to be able to adapt to the shape of the boot. The operation to be carried out just once, when the boot is first slotted on.

Finally, in operation, the entry/exit of the boot into/from the apparatus takes place from above, as in conventional bindings, by firstly taking care of disengaging the pumping element 14/20 from the corresponding toothed strap 8/21 and then rotating the entire single strap 5 on the pivots 27, to completely free the support area of the boot.

From what has been described above it is obvious that the predetermined purpose has been accomplished, that of being able to make a snowboard binding that has all of the essential conditions to ensure simplified use with maximum safety. In particular, thanks to the fixed length of the connecting rod 10, any possible rotation of the strap 8/21 is eliminated, thus avoiding the boot being able to lift up and thus lose contact with the support base of the binding.

Of course, further embodiments are possible, according to the shape and size of the shell of the boot, of the base of the binding and of the fastening system, without for this reason departing from the scope of the following claims.

What is claimed is:

1. A snowboard binding, comprising:

a base of said binding;

a single strap (5) hingedly connected at a first end to the base of said binding and forming a collar for a snowboard boot used in said snowboard binding and resting on said base;

a fastening system applied to the base of said binding forming a three sided frame, one of said sides consisting of the base of said binding, said fastening system including a toothed strap (8) connected to the base (2) of said binding, a quick fastener (15) formed of a sliding block (13), adapted to slide freely on said toothed strap (8), and a pumping element (14), whereby acting on said pumping element (14) slides the quick fastener (15) on said toothed strap (8) to make a self-adjusting fastener able to perfectly set the fastening force of said single strap (5) on a snowboard boot in said binding; and a second end of said single strap (5) being releasably fastened to said fastening system.

2. A snowboard binding, comprising:

a base of said binding;

a single strap (5) hingedly connected at a first end to the base of said binding and forming a collar for a snowboard boot used in said snowboard binding and resting on said base;

a fastening system applied to the base of said binding forming a three sided frame, one of said sides consisting of the base of said binding, said fastening system including a quick fastener (15) having a block (13) connected to a toothed strap (8) connected to the base (2) of said binding, wherein said block (13) is connected to said toothed strap (8) by a fixed ratchet (16) protruding from a base (17) of said block and which engages one of a plurality of longitudinal holes (18) in said toothed strap (8) to form a fastener that is adjustable in setting but with a fixed position; and a second end of said single strap (5) being releasably fastened to said fastening system.

3. A snowboard binding, comprising:

a base of said binding;

a single strap (5) hingedly connected at a first end to the base of said binding and forming a collar for a snowboard boot used in said snowboard binding and resting on said base;

a fastening system applied to the base of said binding forming a three sided frame, one of said sides consisting of the base of said binding, said fastening system including a quick fastener (15) having a block (13) connected to a toothed strap (8) connected to the base (2) of said binding by an elastic ratchet (16) formed on a flexible foil (19) mounted cantilevered on a base (17) of said block (13) to form a fastener that is adjustable in setting but with a fixed position; and a second end of said single strap (5) being releasably fastened to said fastening system.

* * * * *